US009030287B2

(12) United States Patent
Motomiya et al.

(10) Patent No.: US 9,030,287 B2
(45) Date of Patent: May 12, 2015

(54) COMMON MODE NOISE FILTER

(75) Inventors: Yoshiyuki Motomiya, Takasaki (JP); Koji Taketomi, Takasaki (JP); Kenichiro Nogi, Takasaki (JP); Takumi Takahashi, Takasaki (JP); Katsuyuki Kayahara, Takasaki (JP)

(73) Assignee: Taiyo Yuden Co., Ltd., Tokyo (JP)

( * ) Notice: Subject to any disclaimer, the term of this patent is extended or adjusted under 35 U.S.C. 154(b) by 0 days.

(21) Appl. No.: 13/824,897

(22) PCT Filed: Sep. 9, 2011

(86) PCT No.: PCT/JP2011/070555

§ 371 (c)(1),
(2), (4) Date: May 3, 2013

(87) PCT Pub. No.: WO2012/039297

PCT Pub. Date: Mar. 29, 2012

(65) Prior Publication Data

US 2013/0249661 A1 Sep. 26, 2013

(30) Foreign Application Priority Data

Sep. 24, 2010 (JP) ..... 2010-213542

(51) Int. Cl.
*H01F 27/24* (2006.01)
*H01F 5/00* (2006.01)
(Continued)

(52) U.S. Cl.
CPC ..... *H01F 27/2804* (2013.01); *H01F 17/0013* (2013.01); *H01F 2017/0066* (2013.01); *H01F 2017/0093* (2013.01)

(58) Field of Classification Search
CPC . H01F 5/003; H01F 17/0006; H01F 17/0013; H01F 27/28; H01F 27/2804
USPC ..... 336/200, 223, 232, 233, 234, 83
See application file for complete search history.

(56) References Cited

U.S. PATENT DOCUMENTS 6,249,205 B1 * 6/2001 Meadors et al. ..... 336/200
2006/0158301 A1 * 7/2006 Shinkai et al. ..... 336/232
(Continued)

FOREIGN PATENT DOCUMENTS

JP H06-045307 U 6/1994
JP 2001-160510 A1 6/2001
(Continued)

OTHER PUBLICATIONS

Notice of Reasons for Refusal issued by Japanese Patent Office, mailed Nov. 20, 2013, for Japanese counterpart application No. 2010-213542.

*Primary Examiner* — Mangtin Lian
(74) *Attorney, Agent, or Firm* — Law Office of Katsuhiro Arai

(57) ABSTRACT

A filter body of a common mode noise filter includes: a non-magnetic body; a first magnetic body and a second magnetic body sandwiching the non-magnetic body; and a first coil conductor and a second coil conductor of planar shape which are embedded in the non-magnetic body and positioned on the first magnetic body side and second magnetic body side in the non-magnetic body in a manner facing each other in a non-contact state; and also has a non-magnetic first protective part and second protective part which are made of a non-magnetic material whose strength is higher than the first magnetic body and second magnetic body and which are positioned on the outermost side of the filter body in a manner sandwiching the first magnetic body and second magnetic body.

2 Claims, 4 Drawing Sheets

(51) Int. Cl.
*H01F 27/28* (2006.01)
*H01F 17/00* (2006.01)

(56) References Cited

U.S. PATENT DOCUMENTS

2009/0003191 A1* 1/2009 Inuzuka et al. ..... 369/283
2009/0011249 A1* 1/2009 Sakamoto ..... 428/428
2010/0295646 A1* 11/2010 Harrison et al. ..... 336/192

FOREIGN PATENT DOCUMENTS

JP 2001-297946 A 10/2001
JP 2005-340611 A1 12/2005
JP 2006-261585 A 9/2006
JP 2006-319009 A1 11/2006
JP 2010-177380 A1 8/2010

* cited by examiner

COMMON MODE NOISE FILTER

This application is the U.S. National Phase under 35 U.S.C. §371 of International Application PCT/JP2011/07055, which claims priority to Japanese Patent Application No. 2010-213542, filed Sep. 24, 2010. The International Application was published under PCT Article 21(2) in a language other than English

TECHNICAL FIELD

The present invention relates to a common mode noise filter used as a noise elimination device in various electronic equipment.

BACKGROUND ART

A common mode noise filter generally has a structure whereby a filter body, constituted by two magnetic bodies sandwiching a non-magnetic body in which two coils are embedded, has two pairs of external terminals provided on it which are each electrically continuous with each of the coils (refer to Patent Literature 1).

Below is an example where the non-magnetic body is made of borosilicate glass and each magnetic body is made of Ni—Zn—Cn ferrite. Since the strength (mechanical strength) of each magnetic body is lower than the strength of the non-magnetic body, when external force is applied to the common mode noise filter as the common mode noise filter is installed on a circuit board, etc., transferred, or the like, the two magnetic bodies positioned on the outermost side of the filter body, especially the ridgelines of each magnetic body, may be chipped. This chipping can lead to volume decrease of each magnetic body and consequently cause the impedance characteristics and other filter characteristics to deteriorate as a result of volume decrease caused by the chipping.

BACKGROUND ART LITERATURES

Patent Literatures

Patent Literature 1: Japanese Patent Laid-open No. 2005-340611

SUMMARY OF THE INVENTION

Problems to Be Solved by the Invention

An object of the present invention is to provide a common mode noise filter that inhibits chipping of the two magnetic bodies sandwiching the non-magnetic body, thereby suppressing the deterioration of its filter characteristics caused by the chipping.

Means for Solving the Problems

To achieve the aforementioned object, the present invention provides a common mode noise filter having a filter body that comprises: a non-magnetic body; a first magnetic body and a second magnetic body sandwiching the non-magnetic body; and a first coil conductor and a second coil conductor of planar shape which are embedded in the non-magnetic body and positioned on the first magnetic body side and second magnetic body side in the non-magnetic body in a manner facing each other in a non-contact state; wherein such common mode noise filter is characterized in that it has a non-magnetic first protective part and second protective part positioned on the outermost side of the filter body in a manner sandwiching the first magnetic body and second magnetic body, where the first protective part and second protective part are made of a non-magnetic material whose strength is higher than the first magnetic body and second magnetic body.

With the common mode noise filter proposed by the present invention, since the exterior surfaces of the first magnetic body and second magnetic body are covered with the first protective part and second protective part which have higher strength than the first magnetic body and second magnetic body, respectively, chipping of the first magnetic body and second magnetic body, especially the ridgelines of the magnetic bodies, can be prevented even when external force is applied to the common mode noise filter as the common mode noise filter is installed on a circuit board, etc., transferred, or the like, which in turn suppresses the deterioration of impedance characteristics and other filter characteristics resulting from volume decrease of the first magnetic body and second magnetic body caused by the chipping. Additionally, because the first protective part and second protective part are made of a non-magnetic material, impedance characteristics and other filter characteristics will not deteriorate due to the presence of the first protective part and second protective part.

Effects of the Invention

According to the present invention, a common mode noise filter is provided which prevents chipping of the two magnetic bodies sandwiching the non-magnetic body, thereby suppressing the deterioration of its filter characteristics caused by the chipping.

The aforementioned object and other objects, constitution and characteristics, and operation and effects, of the present invention are made clear by the explanation below and attached drawings.

BRIEF DESCRIPTION OF THE DRAWINGS

FIG. 2 (S12) is a section view of FIG. 1 cut along line S12; and FIG. 2 (S13) is a section view of FIG. 1 cut along line S13.

MODE FOR CARRYING OUT THE INVENTION

[First Embodiment]

Figure 1:
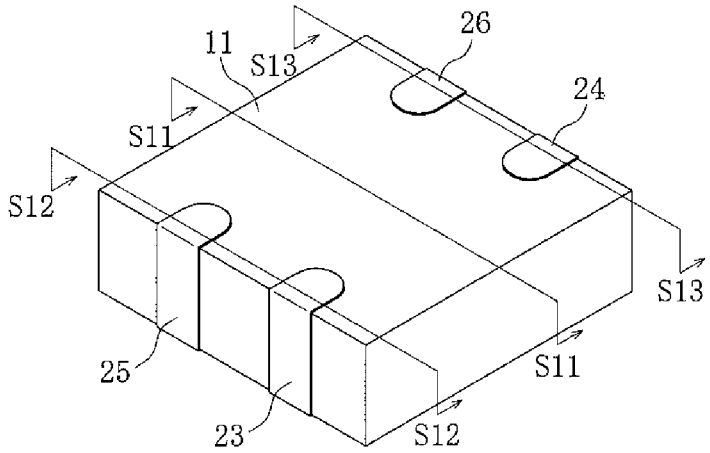
FIG. 1 is an exterior perspective view of a common mode noise filter to which the present invention is applied (first embodiment).

A common mode noise filter to which the present invention is applied (first embodiment) is explained below by citing FIGS. 1 to 3. This common mode noise filter has a filter body 11 of rectangular solid shape, as well as first through fourth external terminals 23 to 26 provided on the opposing two side faces of the filter body 11, as shown in FIG. 1.

Figure 3:
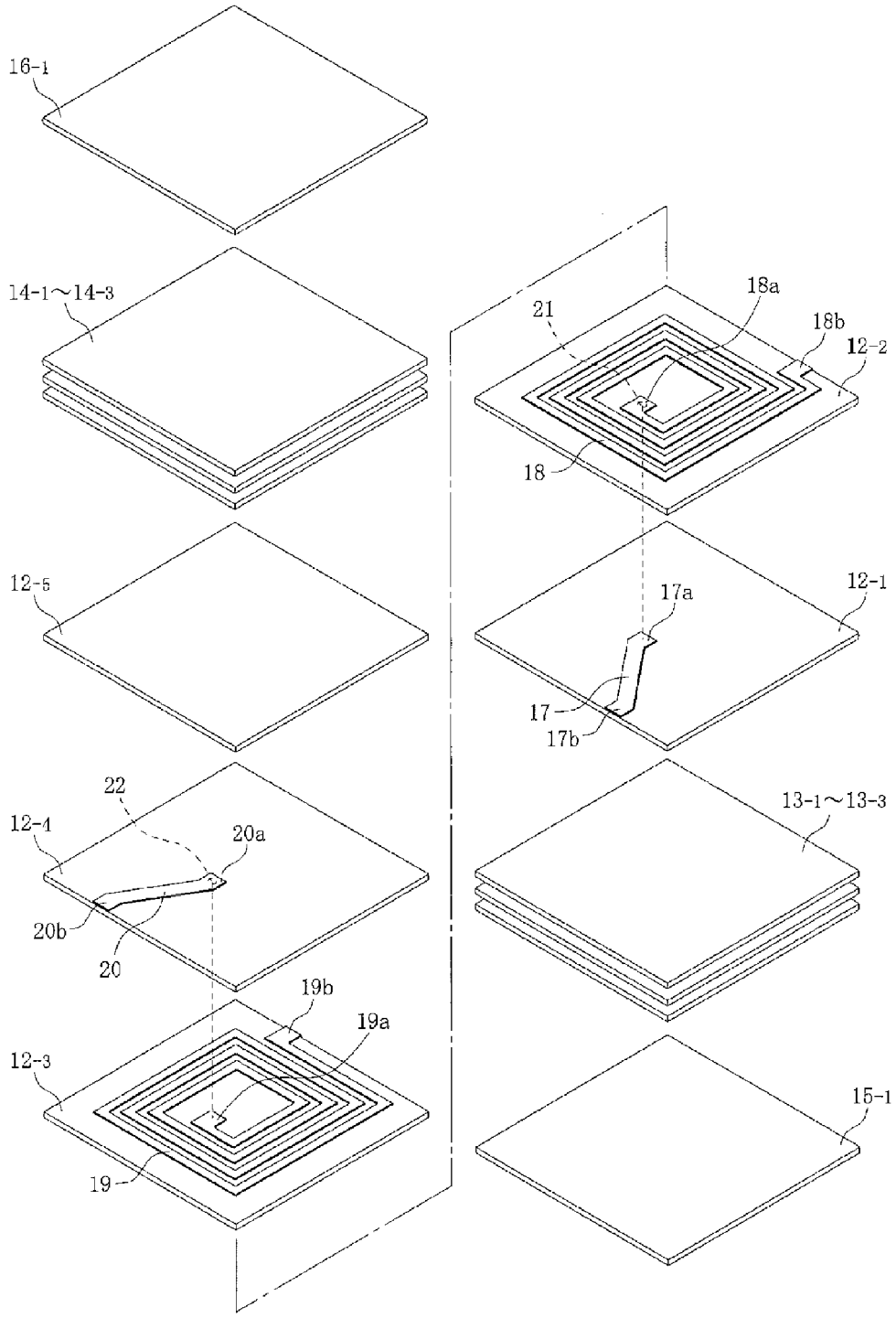
FIG. 3 is an exploded perspective view of each layer of the filter body shown in FIG. 1.

As shown in FIG. 3 which provides an exploded view of each layer of the filter body 11, the filter body 11 comprises:

five first through fifth non-magnetic layers 12-1 to 12-5, three magnetic layers 13-1 to 13-3, three magnetic layers 14-1 to 14-3, one protective layer 15-1, one protective layer 16-1, first lead conductor 17 present between the first non-magnetic layer 12-1 and second non-magnetic layer 12-2, first coil conductor 18 of planar shape present between the second non-magnetic layer 12-2 and third non-magnetic layer 12-3, second coil conductor 19 of planar shape present between the third non-magnetic layer 12-3 and fourth non-magnetic layer 12-4, second lead conductor 20 present between the fourth non-magnetic layer 12-4 and fifth non-magnetic layer 12-5, first via conductor 21 provided in the second non-magnetic layer 12-2, and second via conductor 22 provided in the fourth non-magnetic layer 12-4.

The first through fifth non-magnetic layers 12-1 to 12-5 are made of any known non-magnetic material, preferably dielectric material of low dielectric constant, specifically borosilicate glass or other glass, glass ceramics constituted by glass in which silica, alumina, etc., is dispersed, or the like. Additionally, the magnetic layers 13-1 to 13-3, 14-1 to 14-3 are made of any known magnetic material, preferably Ni—Zn—Cn ferrite or other ferrite material. Moreover, the protective layers 15-1, 16-1 are made of any known non-magnetic material having higher strength (higher mechanical strength) than the magnetic layers 13-1 to 13-3, 14-1 to 14-3, preferably the same dielectric material used for the first through fifth non-magnetic layers 12-1 to 12-5. Furthermore, the first lead conductor 17, first coil conductor 18, second coil conductor 19, second lead conductor 20, first via conductor 21 and second via conductor 22 are made of any known conductor material, preferably silver or other metal material.

Figure 2:
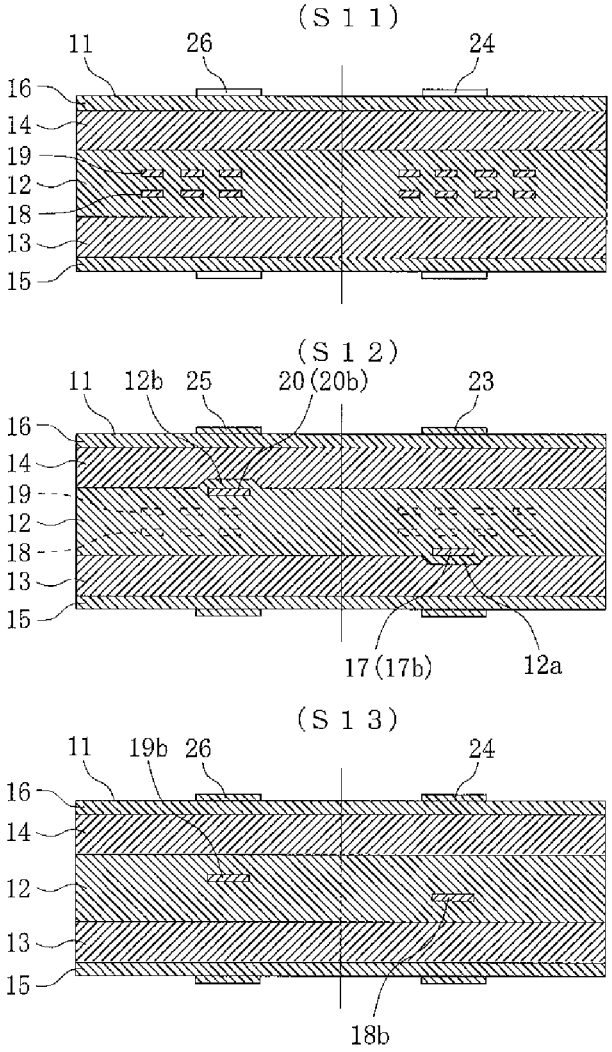
FIG. 2 (S11) is a section view of FIG. 1 cut along line S11.

The five first through fifth non-magnetic layers 12-1 to 12-5 shown in FIG. 3 constitute the non-magnetic body 12 shown in FIG. 2, the three magnetic layers 13-1 to 13-3 constitute the first magnetic body 13 shown in FIG. 2, the three magnetic layers 14-1 to 14-3 constitute the second magnetic body 14 shown in FIG. 2, and the first magnetic body 13 and second magnetic body 14 sandwich the non-magnetic body 12 in a manner tightly contacting the non-magnetic body 12.

Additionally, the one protective layer 15-1 shown in FIG. 3 constitutes the first protective part 15 shown in FIG. 2, the one protective layer 16-1 constitutes the second protective part 16 shown in FIG. 2, and the non-magnetic first protective part 15 and second protective part 16 are positioned on the outermost side of the filter body 11 by sandwiching the first magnetic body 13 and second magnetic body 14 in a manner contacting the first magnetic body 13 and second magnetic body 14, respectively.

The first coil conductor 18 and second coil conductor 19 are each spiraled having roughly the same wire width and roughly the same number of windings. One end 18*a* of the first coil conductor 18 is connected to one end 17*a* of the first lead conductor 17 via the first via conductor 21, while the side edge at the other end 17*b* of the first lead conductor 17 and side edge at the other end 18*b* of the first coil conductor 18 are exposed on the opposing side faces of the non-magnetic body 12. One end 19*a* of the second coil conductor 19 is connected to one end 20*a* of the second lead conductor 20 via the second via conductor 22, while the side edge at the other end 20*b* of the second lead conductor 20 and side edge at the other end 19*b* of the second coil conductor 19 are exposed on the opposing side faces of the non-magnetic body 12.

The first through fourth external terminals 23 to 26 are made of any known conductor material, preferably silver or other metal material. As shown in FIG. 1, the first external terminal 23 and third external terminal 25 are provided on one side face of the filter body 11 with some space between them, while the second external terminal 24 and fourth external terminal 26 are provided on the opposite side face of the filter body 11 with some space between them.

To be specific, the first external terminal 23 is connected to the side edge at the other end 17*b* of the first lead conductor 17 exposed on one side face of the non-magnetic body 12, while the second external terminal 24 is connected to the side edge at the other end 18*b* of the first coil conductor 18 exposed on the opposite side face of the non-magnetic body 12. The third external terminal 25 is connected to the side edge at the other end 20*b* of the second lead conductor 20 exposed on one side face of the non-magnetic body 12, while the fourth external terminal 26 is connected to the side edge at the other end 19*b* of the second coil conductor 19 exposed on the opposite side face of the non-magnetic body 12.

Now, how the aforementioned common mode noise filter is manufactured is explained briefly. To manufacture the common mode noise filter, the following are prepared:

unsintered first non-magnetic layer 12-1 on which an unsintered first lead conductor 17 is formed, unsintered second non-magnetic layer 12-2 on which an unsintered first coil conductor 18 and first via conductor 21 are formed, unsintered third non-magnetic layer 12-3 on which an unsintered second lead conductor 19 is formed, unsintered fourth non-magnetic layer 12-4 on which an unsintered second lead conductor 20 and second via conductor 22 are formed, unsintered fifth non-magnetic layer 12-5, unsintered magnetic layers 13-1 to 13-3, 14-1 to 14-3, and unsintered protective layers 15-1, 16-1.

These layers are layered in the order shown in FIG. 3 and the entire laminate is thermally pressure-bonded, after which the thermally pressure-bonded laminate is sintered (and also binder-removed) at a specified temperature to produce a filter body 11. Thereafter, unsintered first through fourth external terminals 23 to 26 are formed on the two opposing side faces of the filter body 11, and they are sintered (and also binder-removed) at the specified temperature. If necessary, nickel layers are formed by the electroplating method on the surfaces of the first through fourth external terminals 23 to 26, and solder layers are formed on top by the electroplating method.

As described above, the first lead conductor 17 is present between the first non-magnetic layer 12-1 and second non-magnetic layer 12-2, the first coil conductor 18 is present between the second non-magnetic layer 12-2 and third non-magnetic layer 12-3, the second coil conductor 19 is present between the third non-magnetic layer 12-3 and fourth non-magnetic layer 12-4, and the second lead conductor 20 is present between the fourth non-magnetic layer 12-4 and fifth non-magnetic layer 12-5.

Accordingly, the first coil conductor 18 is positioned in the non-magnetic body 12 on the first magnetic body 13 side, while the second coil conductor 19 is positioned in the non-magnetic body 12 on the second magnetic body 14 side, and the first coil conductor 18 and second coil conductor 19 are buried in the non-magnetic body 12 in a manner facing each other in a non-contact state (refer to FIG. 2 (S11)).

Additionally, the first lead conductor 17 is buried in the non-magnetic body 12 except for the side edge at the other end 17*b* (where it is connected to the first external terminal 23), and also the second lead conductor 20 is buried in the non-magnetic body 12 except for the side edge at the other end 20*b* (where it is connected to the third external terminal 25) (refer to FIG. 2 (S12)).

Furthermore, because the entire laminate is thermally pressure-bonded in the manufacturing process, a part 12*a* of the non-magnetic body 12 covering the first lead conductor 17 present at a position closer to the first magnetic body 13 than the first coil conductor 18 protrudes toward the first magnetic body 13 and bites into the first magnetic body 13, and also a part 12*b* of the non-magnetic body 12 covering the second lead conductor 20 present at a position closer to the second magnetic body 14 than the second coil conductor 19 protrudes toward the second magnetic body 14 and bites into the second magnetic body 14 (refer to FIG. 2 (S12)).

As described above, the aforementioned common mode noise filter has the non-magnetic first protective part 15 and second protective part 16 which are made of a material whose strength is higher than the first magnetic body 13 and second magnetic body 14 and which are positioned on the outermost side of the filter body 11 by sandwiching the first magnetic body 13 and second magnetic body 14. In other words, because the exterior surfaces of the first magnetic body 13 and second magnetic body 14 are covered with the first protective part 15 and second protective part 16 which have higher strength than the first magnetic body 13 and second magnetic body 14, respectively, chipping of the first magnetic body 13 and second magnetic body 14, especially the ridgelines of the magnetic bodies 13, 14, can be prevented even when external force is applied to the common mode noise filter as the common mode noise filter is installed on a circuit board, etc., transferred, or the like, which in turn suppresses the deterioration of impedance characteristics and other filter characteristics resulting from volume decrease of the first magnetic body 13 and second magnetic body 14 caused by the chipping. Additionally, because the first protective part 15 and second protective part 16 are made of a non-magnetic material, impedance characteristics and other filter characteristics will not deteriorate due to the presence of the first protective part 15 and second protective part 16.

Also with the aforementioned common mode noise filter, the non-magnetic body 12 is made of a dielectric material of low dielectric constant, and the first protective part 15 and second protective part 16 made of the same dielectric material as the non-magnetic body 12 are provided on the outermost side of the filter body 11, and therefore when the common mode noise filter is mounted on a circuit board, etc., in such a way that either the first protective part 15 or second protective part 16 faces the surface of the circuit board, etc., interference between the magnetic field generated by other circuit patterns on the circuit board, etc., and the magnetic field generating inside the common mode noise filter, can be suppressed. In other words, mutual interference between the magnetic field generating inside the common mode noise filter, and an external magnetic field, can be suppressed, which in turn prevents deterioration of filter characteristics, especially high-frequency characteristics. In addition, the manufacturing method is such that layers identical to the first through fifth non-magnetic layers 12-1 to 12-5 constituting the non-magnetic body 12 can be used as the protective layers 15-1, 16-1 to constitute the first protective part 15 and second protective part 16, which has the benefit of eliminating the need to prepare layers of a different material to constitute the first protective part 15 and second protective part 16.

Additionally with the aforementioned common mode noise filter, the dielectric constant of the first protective part 15 and second protective part 16 can be lowered considerably by adopting borosilicate glass or glass ceramics as the dielectric material with which to form the non-magnetic body 12, first protective part 15 and second protective part 16, which more effectively suppresses mutual interference between the magnetic field generating inside the common mode noise filter and an external magnetic field. In addition, the manufacturing method is such that, if the first through fourth external terminals 23 to 26 are made of silver or other metal material, the first through fourth external terminals 23 to 26 can be strongly joined to the non-magnetic body 12, first protective part 15 and second protective part 16 made of borosilicate glass or glass ceramics, which also prevents separation of the first through fourth external terminals 23 to 26 from the manufactured common mode noise filter.

[Second Embodiment]

Figure 4:
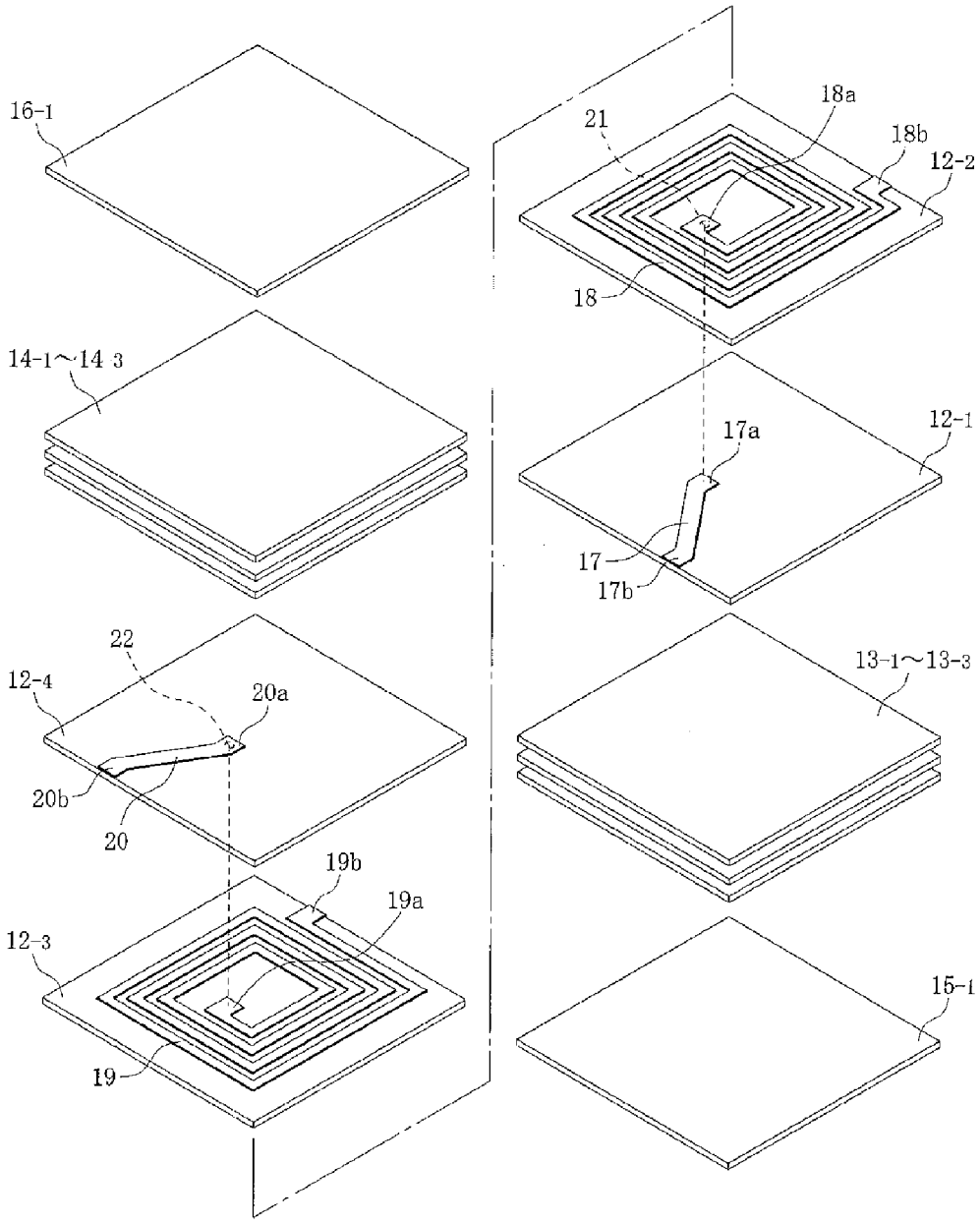
FIG. 4 is an exploded perspective view of each layer of the filter body of a common mode noise filter to which the present invention is applied (second embodiment).

A common mode noise filter to which the present invention is applied (second embodiment) is explained by citing FIG. 4. This common mode noise filter is different from the aforementioned common mode noise filter (first embodiment) in that:

- the fifth non-magnetic layer 12-5 is eliminated and the non-magnetic body 12 shown in FIG. 2 is constituted by the four first through fourth non-magnetic layers 12-1 to 12-4, and
- the second lead conductor 20 is present between the fourth non-magnetic layer 12-4 and magnetic layer 14-1.

With this common mode noise filter, where the fifth non-magnetic layer 12-5 is eliminated, the part denoted by the reference numeral 12*b* in FIG. 2 (S12) is no longer formed, but the same effects of the aforementioned common mode noise filter (first embodiment) can still be achieved.

[Third Embodiment]

Figure 5:
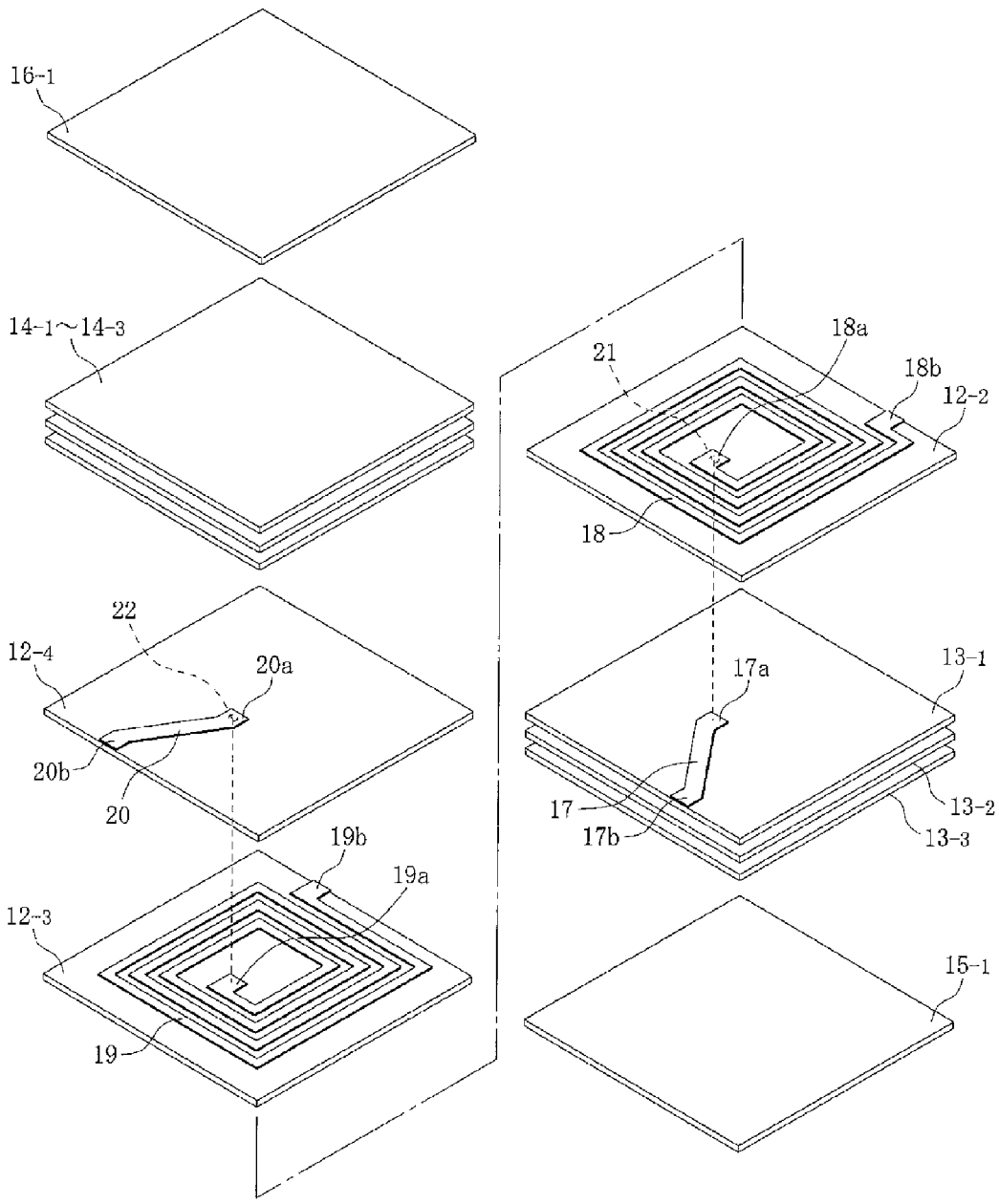
FIG. 5 is an exploded perspective view of each layer of the filter body of a common mode noise filter to which the present invention is applied (third embodiment).

A common mode noise filter to which the present invention is applied (third embodiment) is explained by citing FIG. 5. This common mode noise filter is different from the aforementioned common mode noise filter (first embodiment) in that:

- the first non-magnetic layer 12-1 and fifth non-magnetic layer 12-5 are eliminated and the non-magnetic body 12 shown in FIG. 2 is constituted by the three second through fourth non-magnetic layers 12-2 to 12-4,
- the first lead conductor 17 is present between the magnetic layer 13-1 and second non-magnetic layer 12-2, and
- the second lead conductor 20 is present between the fourth non-magnetic layer 12-4 and magnetic layer 14-1.

With this common mode noise filter, where the first non-magnetic layer 12-1 and fifth non-magnetic layer 12-5 are eliminated, the parts denoted by the reference numerals 12*a* and 12*b* in FIG. 2 (S12) are no longer formed, but the same effects of the aforementioned common mode noise filter (first embodiment) can still be achieved.

[Other Embodiments]

(1) Although [First Embodiment] above illustrates an example where the one first non-magnetic layer 12-1 lies between the three magnetic layers 13-1 to 13-3 and first lead conductor 17, and the one fifth non-magnetic layer 12-5 lies between the second lead conductor 20 and three magnetic layers 14-1 to 14-3, the same effects as mentioned above can still be achieved even when two or more first non-magnetic layers 12-1 lie between the three magnetic layers 13-1 to 13-3 and first lead conductor 17, and two or more fifth non-magnetic layers 12-5 lie between the second lead conductor 20 and three magnetic layers 14-1 to 14-3.

(2) Although [First Embodiment] through [Third Embodiment] above indicate structures where the first magnetic body 13 is constituted by three magnetic layers 13-1 to 13-4 and the second magnetic body 14 is constituted by three magnetic layers 14-1 to 14-4, the same effects as mentioned above can still be achieved even when the number of magnetic layers constituting each magnetic body 13, 14 is increased or decreased as desired according to the thickness of the magnetic layer, thickness of each magnetic body 13, 14, and so on.

(3) Although [First Embodiment] through [Third Embodiment] above indicate structures where the first protective part 15 is constituted by the one protective layer 15-1 and the second protective part 16 is constituted by the one protective layer 16-1, the same effects as mentioned above can still be achieved even when the number of protective layers constituting each protective part 15, 16 is increased or decreased as desired according to the thickness of the protective layer, thickness of each protective part 15, 16, and so on.

(4) Although [First Embodiment] through [Third Embodiment] above indicate that the first coil conductor 18 and second coil conductor 19 are straight conductor wires of the specified wire width which are spiraled along corners of roughly right angles, the same effects as mentioned above can still be achieved even when they are straight conductor wires of the specified wire width which are spiraled along curved corners, or conductor wires of the specified wire width which are entirely curved in a spiraling manner.

(5) Although [First Embodiment] through [Third Embodiment] above indicate that the common mode noise filter has one pair of coil conductors 18, 19 and two pairs of external terminals 23 to 26 corresponding to the one pair of coil conductors 18, 19, the same effects as mentioned above can still be achieved even when a common mode noise filter of double coil pairs is constituted where the filter body is formed long sideways and two pairs of coil conductors are embedded side by side and then four pairs of external terminals corresponding to the two pairs of coil conductors are provided, or when a common mode noise filter of three or more coil pairs is constituted.

DESCRIPTION OF THE SYMBOLS

11—Filter body
12—Non-magnetic body
13—First magnetic body
14—Second magnetic body
15—Non-magnetic first protective part
16—Non-magnetic second protective part
17—First lead conductor
18—First coil conductor
19—Second coil conductor
20—Second lead conductor
21—First via conductor
22—Second via conductor
23—First external terminal
24—Second external terminal
25—Third external terminal
26—Fourth external terminal

What is claimed is:

1. A common mode noise filter having a filter body that comprises:

a non-magnetic body;

a first magnetic body and a second magnetic body sandwiching the non-magnetic body; and a first coil conductor and a second coil conductor of planar shape which are embedded in the non-magnetic body and positioned on the first magnetic body side and second magnetic body side in the non-magnetic body in a manner facing each other in a non-contact state;

wherein the common mode noise filter has a non-magnetic first protective part and second protective part positioned on an outermost side of the filter body in a manner sandwiching the first magnetic body and second magnetic body, respectively, where the first protective part and second protective part consist of a non-magnetic material whose strength is higher than the first magnetic body and second magnetic body, said non-magnetic material consisting of borosilicate glass, wherein the non-magnetic body is made of the same composition as the first protective part and second protective part.

2. A common mode noise filter according to claim 1, wherein the non-magnetic body, the first magnetic body, the second magnetic body, the first protective part, and the second protective part are constituted by layers, respectively, which layers are sintered simultaneously.

* * * * *